United States Patent [19]

McNally

[11] 4,193,144

[45] Mar. 18, 1980

[54] LAVATORY SEAT

[76] Inventor: Ronald McNally, 29 Lewis St., Bedlinog, Treharris, Mid Glamorgan, Wales

[21] Appl. No.: 921,673

[22] Filed: Jul. 3, 1978

[30] Foreign Application Priority Data

Jul. 6, 1977 [GB] United Kingdom ..... 28201/77

[51] Int. Cl.[2] ..... A47K 13/00; A47K 13/30

[52] U.S. Cl. ..... 4/229; 4/233

[58] Field of Search ..... 4/229, 233, 234, 237, 4/1

[56] References Cited

U.S. PATENT DOCUMENTS

| | | | |
|---|---|---|---|
| 866,400 | 9/1907 | Stevens | 4/229 |
| 919,512 | 4/1909 | Young | 4/229 |
| 1,492,825 | 5/1924 | Abbott | 4/229 X |
| 2,033,663 | 3/1936 | Witte | 4/229 |
| 2,961,664 | 11/1960 | Davidson | 4/229 |
| 3,249,951 | 5/1966 | Thompson | 4/229 |
| 3,801,999 | 4/1974 | McNally | 4/229 |

FOREIGN PATENT DOCUMENTS

| | | | |
|---|---|---|---|
| 1043969 | 11/1958 | Fed. Rep. of Germany | 4/229 |
| 1340075 | 12/1973 | United Kingdom | 4/229 |

*Primary Examiner*—Henry K. Artis

*Attorney, Agent, or Firm*—Blanchard, Flynn, Thiel, Boutell & Tanis

[57] ABSTRACT

The invention provides a plastics lavatory seat which has an internal channel or cavity for containing liquid disinfectant and/or deodorant of the phenolic or cationic kind, the liquid and the plastics being compatible and the plastics being permeable to and capable of absorbing the liquid so that a hygienic seat is obtained.

4 Claims, 3 Drawing Figures

LAVATORY SEAT

The invention relates to a lavatory seat.

A lavatory seat is known in which vapour of a disinfectant and/or deodorant is supplied to a surface of the seat through pores through the thickness of the material of the seat. The pores extend between the surface and a hollow interior of the seat in which liquid disinfectant and/or deodorant is housed. However, although it has been found that this seat is hygienic on its upper surface there is sometimes not such a good bactericidal action in the underside of the seat and it is on the underside that there is sometimes spread of infection by splashing from a lavatory bowl to which the seat is affixed.

It is accordingly among the objects of the invention to seek to mitigate this disadvantage.

According to one aspect of the invention there is provided a lavatory seat, comprising a material which is permeable to liquid disinfectant and/or deodorant.

According to a second aspect of the invention there is provided a lavatory seat which has a distribution device for a liquid disinfectant and/or deodorant, and which comprises a material which is permeable to disinfectant and/or deodorant.

The material, which may comprise a body supporting surface of the seat and a boundary surface for part of the cavity, may be a plastic material.

The plastics may comprise perspex, polypropylene, acrylonitrile butadiene styrene (ABS), polyvinyl chloride or polyethylene.

The whole seat may comprise the plastics.

Where the whole seat is made of plastics, it may be formed by blow moulding, in for example a one-shot moulding process.

The seat may include means for charging the cavity with disinfectant and/or deoderant. The charging means may comprise a removable filler cap.

The filler cap may be transparent and may be so arranged that there is in use an air gap between its lower surface and the upper level of liquid in the (horizontal) seat. The air gap ensures that when the seat is raised and lowered, the (liquid) disinfectant and/or deodorant, in liquid form, flows around the cavity which ensures a good mixing of the liquid, while the transparent nature of the cap allows the colour of the liquid to be monitored. This is to enable the state of the disinfectant to be controlled, because it changes colour as it becomes spent.

There may be means to secure the cap against tampering e.g. by vandals.

A construction embodying the invention is hereinafter described by way of example, with reference to the accompanying drawings, in which.

Figure 1:
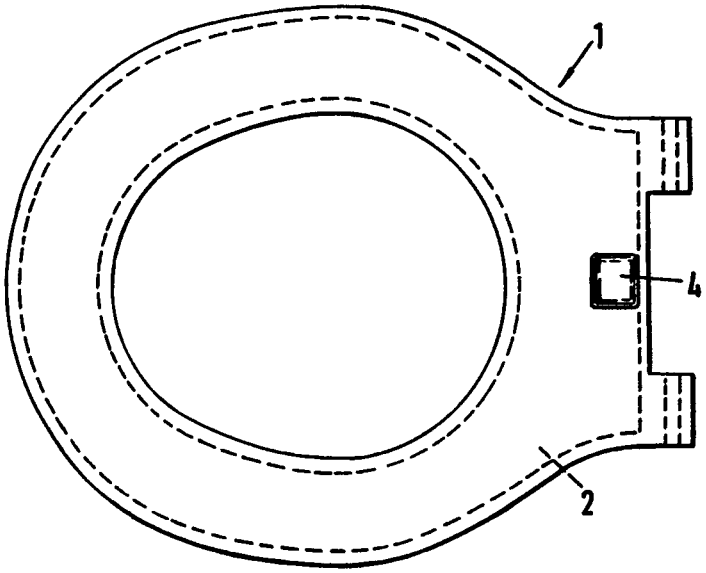
FIG. 1 shows a plan view of a lavatory seat embodying the invention.
Figure 2:
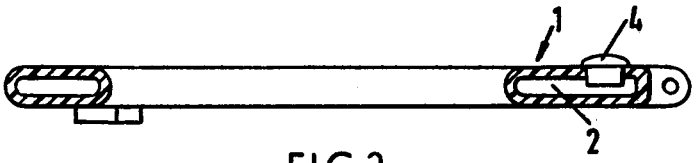
FIG. 2 shows a longitudinal sectional view of the seat of FIG. 1.
Figure 3:
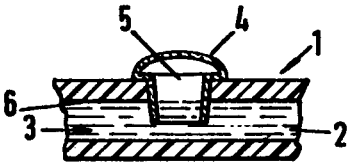
FIG. 3 shows an enlarged sectional view of part of the seat of FIGS. 1 and 2, at the filler cap.

Referring to the drawings there is shown a lavatory seat 1 which has an internal cavity 2 which extends throughout the whole seat. The cavity 2 is for containing liquid disinfectant 2 (FIG. 3) (though liquid deodorant could be used alternatively or in addition). The cavity 2 is wide but not deep and is made integrally with the seat 1 when that seat is made by blow moulding polyvinyl chloride. The polyvinyl chloride is permeable to the disinfectant 3. The cavity 2 is filled through charging means in the form of a filler cap 4. The cap 4 is transparent and is so constructed and arranged that there is an air gap 5 between it and the inner surface 6 of the upper boundary of the cavity 2.

In use, the cavity 2 is filled with water through the charging opening when the cap 4 is removed. Disinfectant in liquid capsule, tablet, powder or paste form is then added to the water and disperses or dissolves in it. The cap is placed in position in the seat.

When the seat 1 is raised and lowered, the liquid disinfectant flows round the cavity and is thoroughly mixed and also thoroughly contacts the material of the seat. This movement is provided for by the air gap 5, into and out of which the liquid can flow.

The disinfectant slowly permeats through the material of the seat, so disinfecting all its surfaces and rendering them hygienic, but it does not "wet" the seat which is therefore comfortable to use. The rate of penetration depends on the thickness of the plastics used. It will also be understood that the water is a carrier for the disinfectant which it brings into intimate contact with the seat and enhances its penetration therethrough.

The disinfectant has a particular colour. As it becomes spent, its colour changes. This change can be observed through the transparent cap 4 and, when required, more disinfectant, paste or the like can be added to re-charge disinfectant to restore it to its correct strength. Of course, the seat can be made in other ways, for example by blow moulding, injection moulding, rotational moulding, a plastics spinning operation or in any other suitable way such as cellular blow moulding of a suitable exp ndible plastics. In this case the body of the seat would comprise a thin skin backed by a porous or foam structure, but there would be no pores extending through the skin. To open pore structure would facilitate the diffusion of the disinfectant.

The disinfectant may be a phenolic disinfectant such as:

(a) Chloroxylenol (4-chloro-3:5-xylenol)

(b) Chlorocresol (4-chloro -3-methylphenol)

(c) Sudol (a proprietary blend of a closely cut fraction of phenols, chiefly xylenols and ethyl phenols.)

The phenolic system contains 50% phenols solubilised by vegetable soap.

Alternatively the disinfectant may be a cationic disinfectant such as chlorhexidine gluconate (1:6-di-CN -4-chlorophenyl-di-guanido)-hexane digluconate).

Chlorhexidine gluconate is totally miscible with water and Sudol is formulated in a vehicle which allows ready dilution with water. Chlorocresol and chloroxylenol are both sparingly soluble in water (0.4% and 0.03% respectively and can be dissolved in aqueous polyethylene glycol (PEG 400) to form cosolvent mixtures. PEG 400 is an acceptable cosolvent for external medicinal use as on a lavatory seat.

It has been found that the total uptake, and hence the "reservoir" of disinfectant in the plastics material of the seat is greater for aqueous chlorocresol, than for chloroxylenol in 10% PEG 400.

Plastics material which can be used are, in addition to the unplasticised PVC mentioned, filled acrylonitrite butadiene styrene (ABS), cellulose-acetate butyrate (CAB), polypropylene and polyurethane. I have found that the permeation rate of chlorocresol through CAB is ten times greater than through polypropylene, while still maintaining the plastics in a "dry" state, that is to say the plastics was not uncomfortable to use.

In both cases, too, there was considerable sorption of the disinfectant by the plastics, so that the whole body of plastics comprising the seat was rendered hygienic and disinfected.

The efficacy of plastics permeable to liquid disinfectant for removing organisms or bacteria, is shown in the following specific Example.

EXAMPLE

ORGANISMS

*Escherichia coli:* NCTC 8196
*Staphylococcus aureus:* NCTC 6571
*Pseudomonas aeruginosa:* NCTC 6749
*Streptococcus faecalis:* NTCT 775

All organisms were grown to stationary phase in nutrient broth, filtered and resuspended in non nutritive buffer at a concentration of approximately $5\times10^7$ orgs. $ml^{-1}$.

PLASTICS

The plastics is polypropylene. Discs of 2.5 cm diameter were cut out and equilibrated with the disinfectant chlorocresol.

INOCULATION LEVELS

20 μl of suspension in salt solution with or without 10% serum containing $5\times10^6$ organisms $ml^{-1}$ were inoculated onto each disc as approximately $10\times2$ μl droplets. This gives $10^5$ organisms per disc which is approximately $2\times10^4$ organisms $cm^{-2}$. (This is in the high end of the range of contamination levels encountered on the surface of hospital toilet seats.)

PROCEDURE

Inoculated discs were stored at 20° C. in glass vessels adjusted to a range of humidities by the use of saturated salt solutions. After various time intervals discs were removed and washed in salt solution. The number of viable bacteria in the suspensions obtained was assessed by serial dilution and plating on nutrient agar. Survival, expressed as a fraction of the number inoculated, was calculated by counting the colonies formed after 48 hours at 37° C.

RESULTS

1. The sensitivity of the four organisms to the antimicrobial agent chlorocresol as assessed by 'Minimum Inhibitory Concentration' tests showed that *E. coli* and *Staph. aureus* were inhibited by 0.25% chlorocresol and *Pseudomonas aeruginosa* and *Streptococcus faecalis* were inhibited by 0.5%.

2. The survival of the four organisms when exposed to drying at room temperature and ambient relative humidity indicated that the gram negative organisms, *E. coli* and *Ps. aeruginosa* behaved in a similar fashion.

It will be understood that the lavatory seat illustrated in the drawings and above described can be modified in various ways. Thus the cavity 2 may not be necessary if a suitable polar polymer such as nylon were used because the cellular structure provides the route for the transport of the disinfectant to the surface of the seat. Also the skin or surface layer could be of a different material to the (foamed) core. If the seat is of foamed plastics without a cavity 2, there may be a feed channel for distributing liquid disinfectant throughout the seat. If the channel is a surface groove, a permeable or microporous sheath may be insertable over the seat to cover the groove and through which the disinfectant can pass.

I claim:

1. A lavatory seat having an outer surface including a body supporting surface and a surface for resting adjacent a lavatory bowl when the body supporting surface is supporting a body, a mass of material forming said outer surface and means defining a disinfectant passage communicating with said mass of material, the improvement being comprised in that said body supporting surface is imperforate, said material mass being a homogeneous, nonporous mass of plastics material permeable by said disinfectant liquid and bounded at least by said body supporting surface and passage for absorbing liquid disinfectant from said passage and migrating said liquid disinfectant therethrough and through said imperforate body supporting surface and therewith for uniform, non-wetting disinfection continuously across said body supporting surface.

2. A lavatory seat as defined in claim 1, wherein said permeable material comprises plastics selected from the group consisting of polypropylene, polyvinyl chloride, acrylonitrile butadiene styrene or polyethylene.

3. A lavatory seat as defined in claim 2, including a liquid disinfectant in said cavity and wherein the liquid disinfectant is selected from phenolic and cationic disinfectants.

4. A lavatory seat as defined in claim 1 in which said seat is hollow, said disinfectant passage being a cavity formed within said hollow seat by the surrounding mass of said non-porous, permeable material.

* * * * *